US005423618A

United States Patent [19]

Yano

[11] Patent Number: 5,423,618

[45] Date of Patent: Jun. 13, 1995

[54] PIEZOELECTRIC PRINT HEAD CONTROL DEVICE USING ADJACENT DOT DATA

[75] Inventor: Akio Yano, Kawasaki, Japan

[73] Assignee: Fujitsu Limited, Kanagawa, Japan

[21] Appl. No.: 305,757

[22] Filed: Sep. 14, 1994

Related U.S. Application Data

[63] Continuation of Ser. No. 000,036, Jan. 4, 1993, abandoned.

[30] Foreign Application Priority Data

Jan. 10, 1992 [JP] Japan ..... 4-003409

[51] Int. Cl.[6] ..... B41J 2/295

[52] U.S. Cl. ..... 400/157.1; 400/166; 400/124.16

[58] Field of Search ..... 400/124.16, 157.1 PZ, 400/157.2, 157.3, 166

[56] References Cited

U.S. PATENT DOCUMENTS 5,078,520 1/1992 Yano ..... 400/124 PZ
5,167,459 12/1992 Yano ..... 400/124 PZ
5,190,383 3/1993 Suzuki ..... 400/157.2

FOREIGN PATENT DOCUMENTS

2635398C2 2/1978 Germany .

*Primary Examiner*—David A. Wiecking
*Assistant Examiner*—Steven S. Kelley
*Attorney, Agent, or Firm*—Nidaido Marmelstein Murray & Oram

[57] ABSTRACT

The present invention provides a print head control device for a wire dot printer, capable of preventing the occurrence of ghost dots to enable the wire dot printer to print characters and the like with a high print quality. The print head control device comprises a print head driving circuit for charging and discharging piezoelectric elements to advance and retract a printing wire, and a print head control circuit for controlling the print head driving circuit. The print head control circuit comprises dot detecting units for deciding if a dot to be printed in the next printing cycle is a single dot, the head dot of a row of consecutive dots, the last dot of a row of consecutive dots or an intermediate dot of a row of consecutive dots, charging/discharging period setting units for setting discharge periods respectively for printing a single dot, the head dot of a row of consecutive dots, the last dot of a row of consecutive dots and an intermediate dot of a row of consecutive dots, and a control unit for controlling piezoelectric element charging and discharging operation according to a set discharging period and a set discharging period.

14 Claims, 8 Drawing Sheets

Fig.2(A) DOT PATTERN

Fig.2(B) REBOUND DOTS (EXCESS DOTS)

Fig.2(C) CHARGE AND DISCHARGE OF ADEVICE

Fig.2(D) OPERATION OF A PRINTING WIRE

ROM

| | |
|---|---|
| A 0 = | 120 μsec |
| A 1 = | 120 μsec |
| A 2 = | 100 μsec |
| A 3 = | 180 μsec |
| ⋮ | |
| B 0 = | 30 μsec |
| B 1 = | 20 μsec |
| B 2 = | 20 μsec |
| ⋮ | |

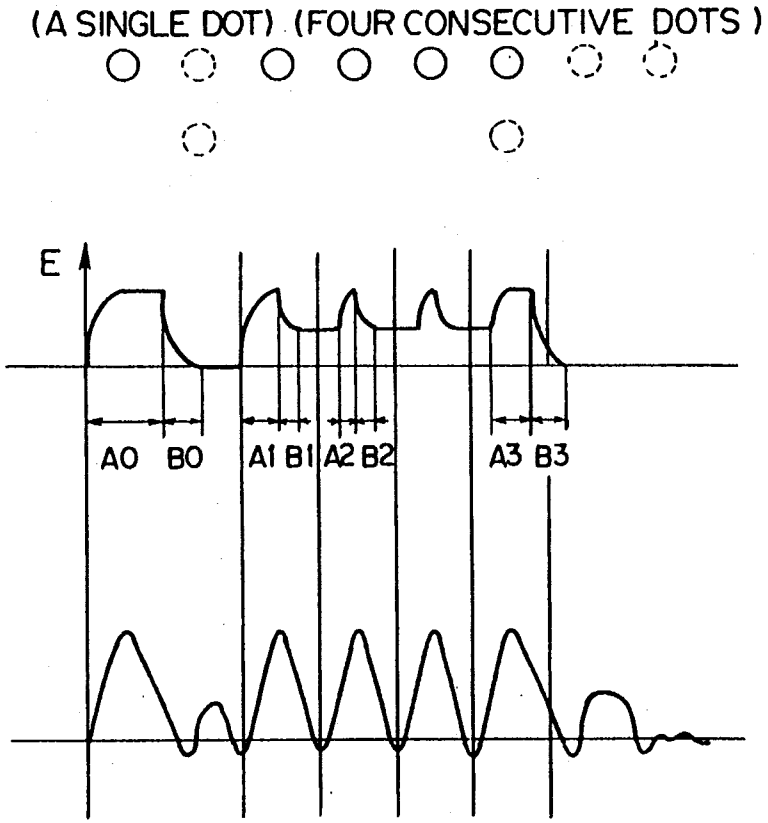
Fig.9(A) DOT PATTERN
Fig.9(B) REBOUND DOTS (EXCESS DOTS)
Fig.9(C) CHARGE AND DISCHARGE OF A DEVICE
Fig.9(D) OPERATION OF A PRINTING WIRE

PIEZOELECTRIC PRINT HEAD CONTROL DEVICE USING ADJACENT DOT DATA

This application is a continuation of application Ser. No. 08/000,036, filed Jan. 4, 1993, now abandoned.

BACKGROUND OF THE INVENTION

1. Field of the Invention

The present invention relates to a print head control device for controlling the operation of the print head of a wire dot printer, provided with printing wires driven by piezoelectric elements, i.e., magnetostrictive elements.

Further increase of the printing speed of the wire dot printer has been desired and efforts have been made to develop a wire dot printer provided with a print head provided with printing wires driven by piezoelectric elements.

2. Description of the Prior Art

A wire dot printer of such a type is proposed in Japanese Unexamined Patent Publication (Kokai) No. 2-241754. The wire dot printer selects a printing wire to be driven for printing from print data received from an external device, determines a charging period for charging piezoelectric elements for driving the selected printing wire and a discharging period for discharging the same piezoelectric elements, and charges and discharges the piezoelectric elements for the charging period and the discharge period, respectively. When charged and discharged, the piezoelectric elements drive the corresponding printing wire by its piezoelectric effect to print a dot on a sheet.

In some cases, the printing wire prints a ghost dot due to a rebounding action caused by kinetic energy. The printing wire is liable to print ghost dots when the wire is driven for a plurality of consecutive printing cycles. Ghost dots have a negative effect on print quality.

SUMMARY OF THE INVENTION

Accordingly, it is an object of the present invention to provide a print head control device for a wire dot printer, capable of preventing ghost dots to print characters and the like with a satisfactorily high print quality.

A print head control device in accordance with the present invention comprises a print head driving circuit and a print head control circuit. The print head driving circuit charges and discharges the piezoelectric elements to drive the printing wire for printing, and the print head control circuit controls the operation of the print head driving circuit according to print data received from an external device.

In a first aspect of the present invention, a print head control circuit comprises: a single dot detecting means for deciding from print data if a dot to be printed in the next print cycle is a single dot; a charging/discharging period setting means for setting a charging period long enough to cancel the rebounding force of the printing wire and a discharging period sufficient for retracting the printing wire when the single dot detecting means decides that a dot to be printed in the next print cycle is a single dot; and a control means for controlling the operation of the charging/discharging period setting means.

In a second aspect of the present invention, a print head control circuit comprises: a last dot detecting means for detecting from print data if a dot to be printed in the next printing cycle is the last dot among a row of consecutive dots; an intermediate dot detecting means for detecting from the print data if a dot to be printed in the next printing cycle is a dot among the intermediate dots of a row of consecutive dots; a first charging/discharging period setting means for setting a charging period and a discharge period so that a force for advancing and a force for retracting the printing wire are reduced when the intermediate dot detecting means detects an intermediate dot; a second charging/discharging period setting means for setting a charging period and a discharge period so that the charging period is longer than that for printing an intermediate dot and the discharge period is sufficient for retracting the printing wire when the last dot detecting means decides that a dot to be printed in the next printing cycle is the last dot; and control means for charging and discharging piezoelectric elements according to the charging period and the discharging period determined by the first or second charging/discharging period setting means.

In a third aspect of the present invention, a print head control circuit comprises: a single dot detecting means for deciding from print data if a dot to be printed in the next printing cycle is a single dot; a head dot detecting means for deciding from the print data if a dot to be printed in the next printing cycle is the head dot among a row of consecutive dots; a last dot detecting means for deciding from the print data if a dot to be printed in the next printing cycle is the last dot among a row of consecutive dots; an intermediate dot detecting means for deciding from the print data if a dot to be printed in the next printing cycle is a dot among the intermediate dots of a row of consecutive dots; a first charging/discharging period setting means for setting a charging period long enough to cancel the rebounding force of the printing wire and a discharging period sufficient for retracting the printing wire; a second charging/discharging period setting means for setting a charging period long enough to drive the printing wire for advancement and a discharging time reducing the printing wire retracting force when the intermediate dot detecting means decides that a dot to be printed in the next printing cycle is a dot among the intermediate dots of a row of consecutive dots; a third charging/discharging period setting means for setting a charging period longer than that for printing an intermediate dot and a discharge period sufficient for retracting the printing wire when the last dot detecting means decides that a dot to be printed in the next printing cycle is the last dot among a row of consecutive dots; and control means for charging and discharging piezoelectric elements according to the charging period and the discharging period set by the first, second or third charging/discharging period setting means.

When printing the last dot of a row of consecutive dots, the piezoelectric elements are charged for a charging period longer than that for printing other dots so that the printing wire is driven for advancement after printing a dot on the sheet to prevent the rebounding of the printing wire by cancelling the rebounding force of the printing wire.

BRIEF DESCRIPTION OF THE DRAWINGS

The present invention will be more clearly understood from the following description taken in connection with the accompanying drawings, in which:

FIGS. 9(A), 9(B), 9(C) and 9(D) are graphs for explaining the operation of a print head control device of the present invention.

DESCRIPTION OF THE PREFERRED EMBODIMENTS

Examples of the related art will be described with reference to the accompanying drawings prior to the description of the preferred embodiments according to the present invention.

Figure 1:
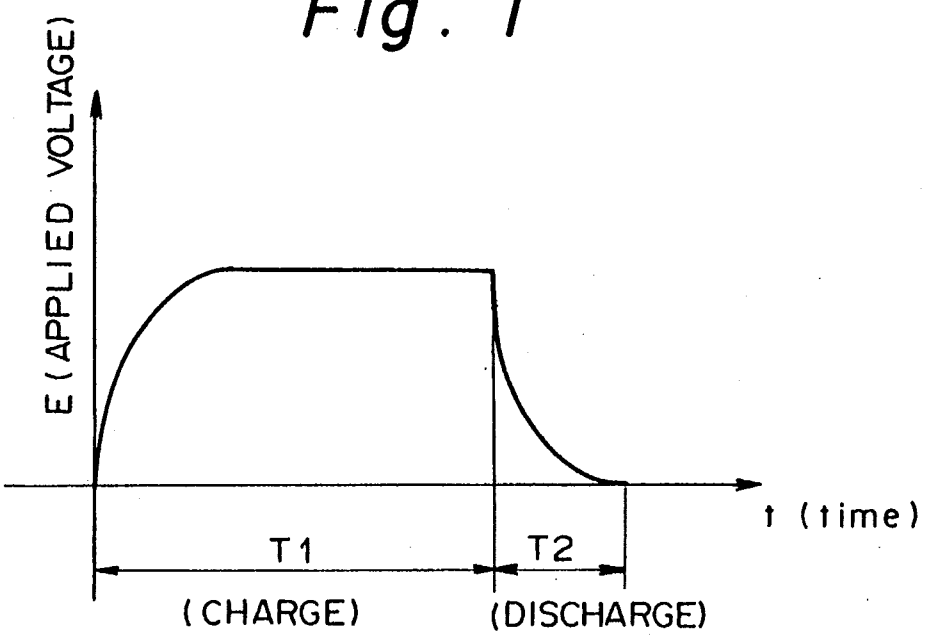
FIG. 1 is a graph for explaining a mode of charging and discharging piezoelectric elements.

Referring to FIG. 1 showing a mode of charging and discharging piezoelectric elements, the piezoelectric elements are charged for a charging period T1 and discharged for a discharging period T2. When charged, the piezoelectric elements extend to advance a printing wire toward a sheet held on a platen for printing. When discharged, the piezoelectric elements contract to retract the printing wire.

Figure 2:
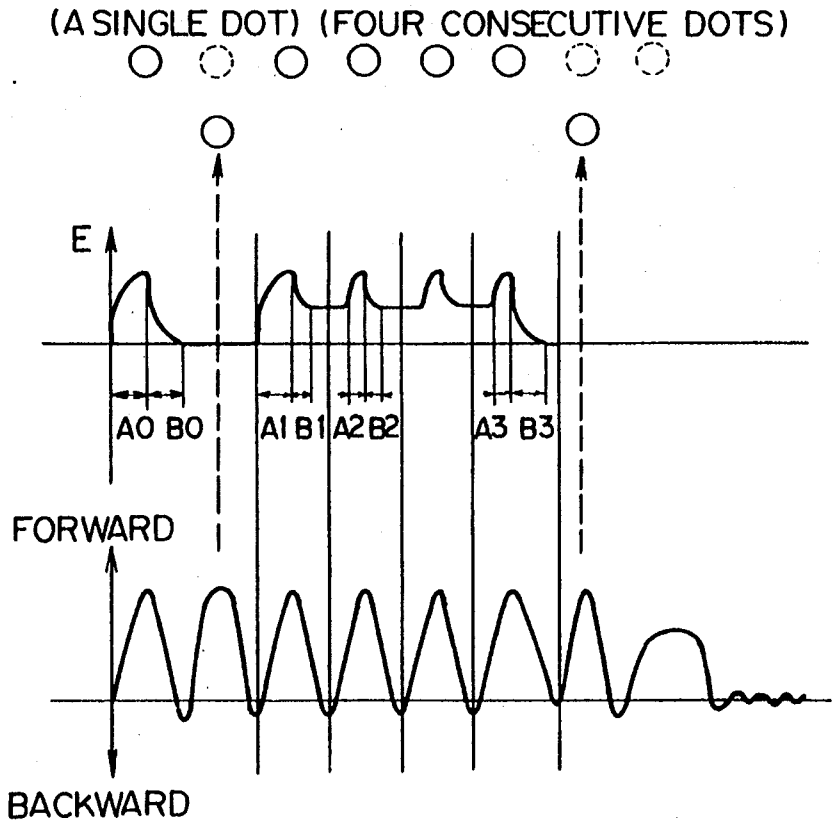
FIGS. 2(A), 2(B), 2(C) and 2(D) are graphs for explaining the operation of a conventional print head control device.

FIG. 2(A) shows a dot pattern consisting of one single dot and four consecutive dots. When printing the single dot, the charging period T1 is A0 and the discharging period T2 is B0 as shown in FIG. 2(C), which are sufficient for operating the printing wire by a sufficiently high driving force as shown in FIG. (D). In some cases, the printing wire assembly rebounds by its kinetic energy after printing a dot, to print a ghost dot, which is liable to occur after printing the last dot of a row of consecutive dots.

If a ghost dot is printed after the single dot or the last one of a row of consecutive dots as shown in FIG. 2(B) due to the rebounding of the printing wire assembly, the print quality is deteriorated. Techniques relating with the foregoing problems are described in U.S. Pat. No. 5,078,520.

Figure 3:
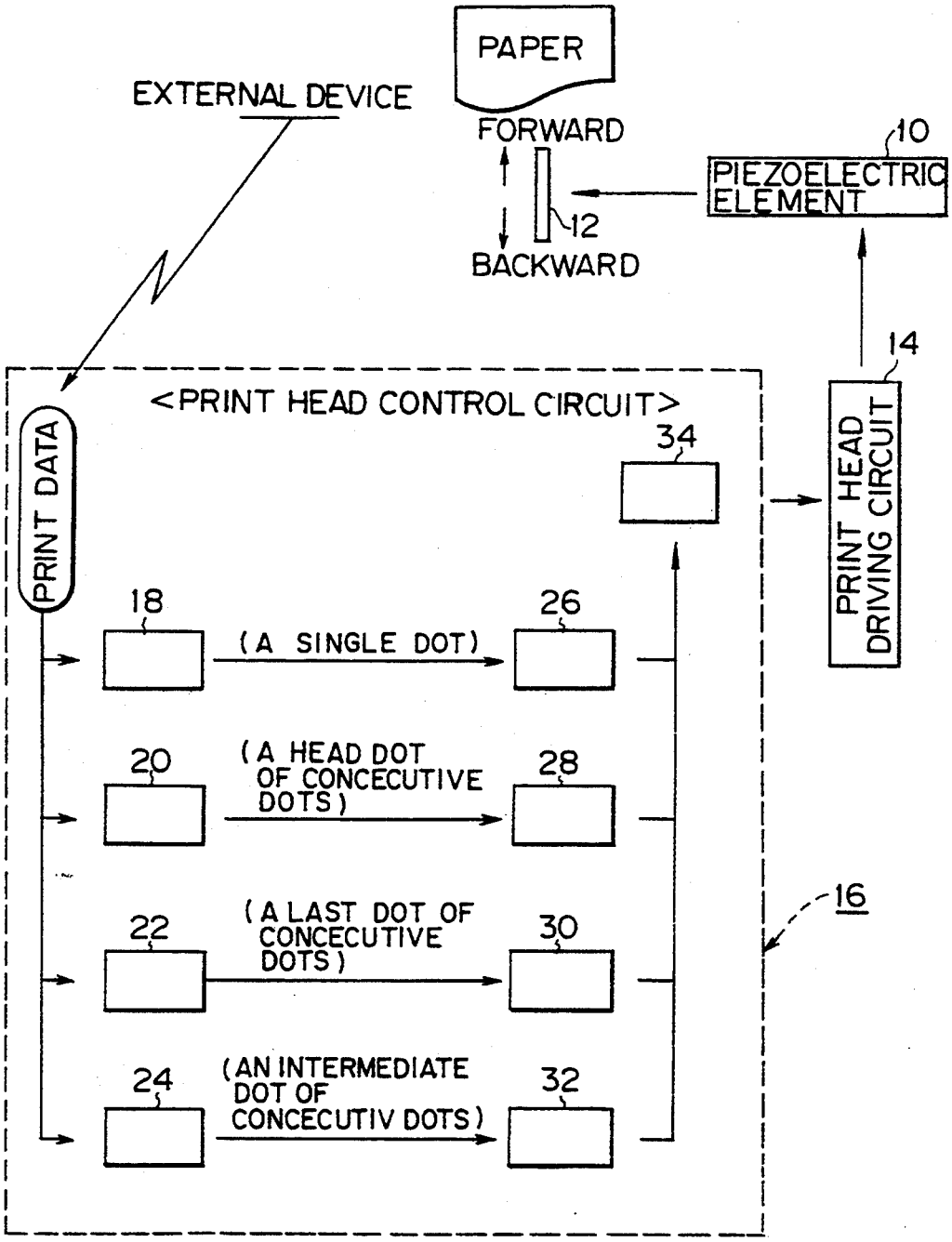
FIG. 3 is a block diagram for explaining the basic configuration of a print head control device according to the present invention.

The present invention has been made to print characters and the like at a satisfactorily high print quality by preventing ghost dots, and a print head control device in accordance with the present invention has a construction as shown in FIG. 3.

Referring to FIG. 3, a print head driving circuit 14 charges and discharges piezoelectric elements 10 to advance and retract a printing wire 12, and a print head control circuit 16 controls the operation of the print head driving circuit 14 for charging and discharging the piezoelectric elements 10 according to print data received from an external device.

The print head control circuit 16 comprises a single dot detecting unit 18 for deciding from the print data if a dot to be printed in the next printing cycle is a single dot, a head dot detecting unit 20 for deciding if a dot to be printed in the next printing cycle is the head dot of a row of consecutive dots, a last dot detecting unit 22 for deciding if a dot to be printed in the next printing cycle is the last dot among a row of consecutive dots, an intermediate dot detecting unit 24 for deciding if a dot to be printed in the next printing cycle is a dot among the intermediate dots of a row of consecutive dots, a first charging/discharging period setting unit 26 for setting a charging period effective for cancelling the rebounding force of a printing wire 12 and a discharge period sufficient for retracting the printing wire 12 when the single dot detecting unit 18 decides that a dot to be printed in the next printing cycle is a single dot, a second charging/discharging period setting unit 28 for setting a charging period sufficient for driving the printing wire 12 and a discharge period suitable for applying a reduced retracting force to the printing wire 12 when the head dot detecting unit 20 decides that a dot to be printed in the next printing cycle is the head dot among a row of consecutive dots, a third charging/discharging period setting unit 32 for setting a charging period and a discharging period so that the printing wire 12 is advanced by a reduced advancing force and retracted by a reduced retracting force when the intermediate dot detecting unit 24 decides that a dot to be printed in the next printing cycle is a dot among the intermediate dots of a row of consecutive dots, a fourth charging/discharging period setting unit 30 for setting a charging period longer than that for printing an intermediate dot and a discharging period sufficient for retracting the printing wire 12 when the last dot detecting unit 22 decides that a dot to be printed in the next printing cycle is the last dot of a row of consecutive dots, and a control unit 34 for controlling charging/discharging operation for charging and discharging the piezoelectric elements 10 according to the charging period and the discharging period set by the first, second, third or fourth charging/discharging period setting unit.

A print head control device for a wire dot printer, in a preferred embodiment according to the present invention will be described hereinafter with reference to FIGS. 4 to 9.

Figure 4:
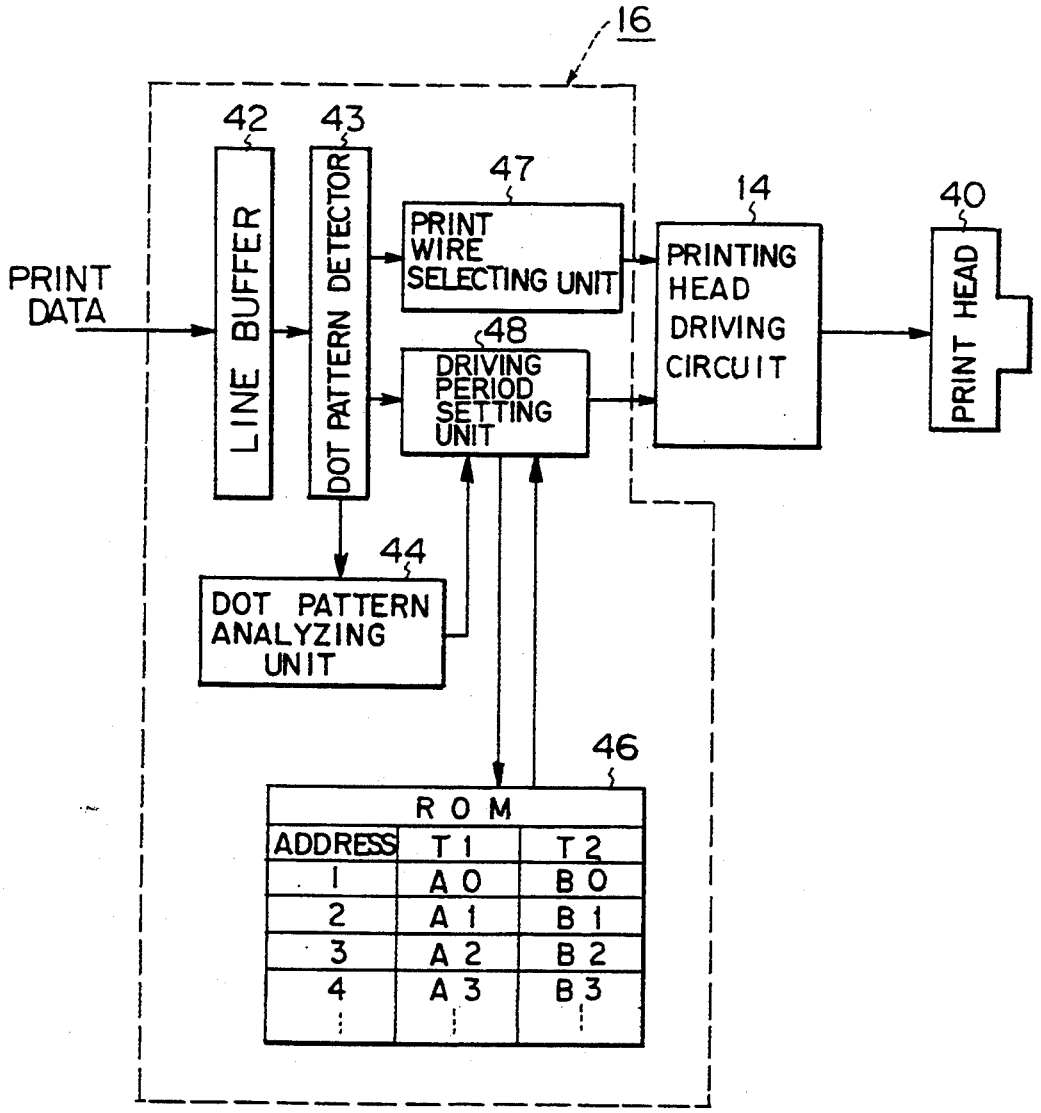
FIG. 4 is a block diagram of a print head control device in a preferred embodiment according to the present invention.
Figures 6, 7:
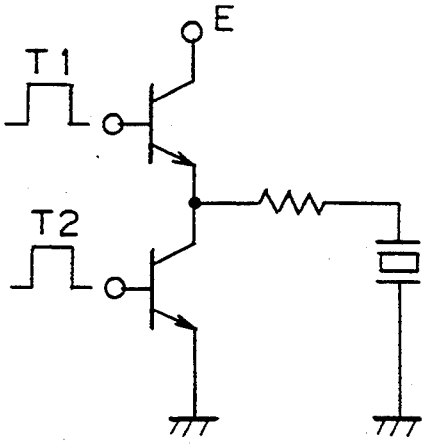
FIG. 6 is a circuit diagram of a print head driving circuit.
FIG. 7 is a table showing the contents of a ROM.

Referring to FIG. 4, a piezoelectric print head 40 is driven by a print head driving circuit 14 consisting of a pair of transistors as shown in FIG. 6, which in turn is controlled by a print head control circuit 16.

The print head control circuit 16 comprises a line buffer 42, a dot pattern detector 43, a dot pattern analyzing unit 44, a ROM 46, a printing wire selecting unit 47 and a driving period setting unit 48.

Print data provided by an external device is applied to the line buffer 42. The dot pattern detector 43 detects the contents of the line buffer 42, and the dot pattern analyzing unit 44 decides that a dot to be printed in the next printing cycle is a single dot, the head dot among a row of consecutive dots, a dot among the intermediate dots of a row of consecutive dots or the last dot among a row of consecutive dots from the output of the dot pattern detector 43, and sends a signal representing the decision to the driving period setting unit 48.

The driving period setting unit 48 reads a charging period A0, A1, A2 or A3, and discharging period B0, B1, B2 or B3 corresponding to the output of the dot pattern analyzing unit 44, and provides control signals corresponding to the data read from the ROM 46 for controlling charging and discharging operation to print a dot according to print data. FIG. 7 shows an example of data stored in the ROM 46.

The control signal provided by the driving period setting unit 48 is applied to the print head driving circuit 14, and then, the print head driving circuit 14 drives the print head 40 according to the control signal to print dots on a sheet held on a platen in a dot pattern represented by the print data. FIG. 6 shows an example of a wire driving unit of the print head driving circuit 14. Charging operation is executed when a pulse T1 is applied to the base of one of the transistors of the wire driving unit, and discharging operation is executed when a pulse T2 is applied to the base of the other transistor.

The printing wire selecting unit 47 selects a printing wire according to the output of the dot pattern detector 43. The output of the printing wire selecting unit 47 is applied to the print head driving circuit 14.

Figure 5:
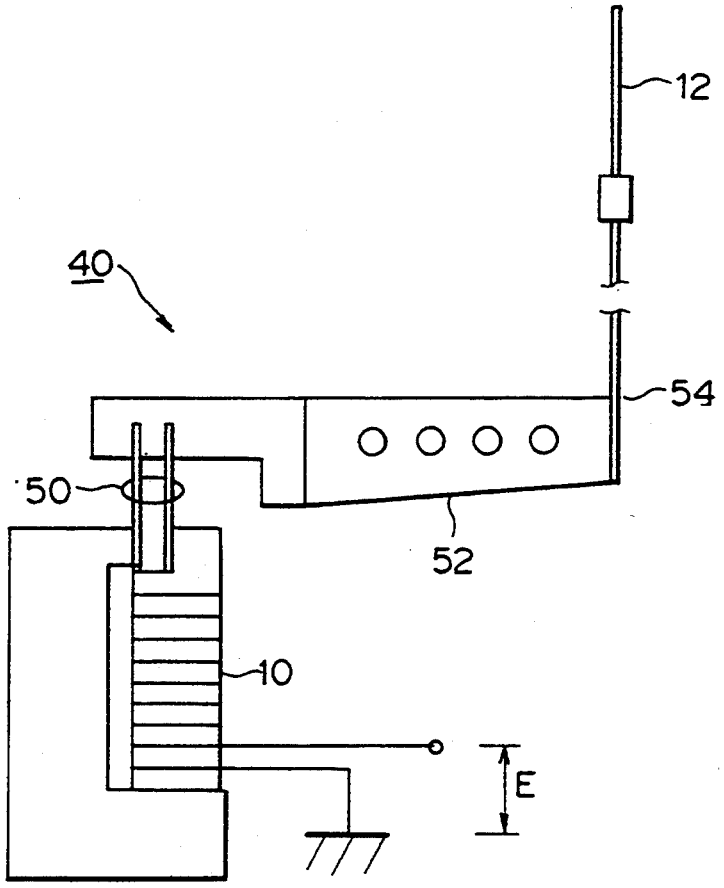
FIG. 5 is a side view of a piezoelectric printing unit.

Referring to FIG. 5, the print head 40 comprises a piezoelectric actuator consisting of a stack of a plurality of piezoelectric elements 10, parallel springs 50, a lever 52, a wire 54 and a printing wire 12. The piezoelectric elements 10 are charged and discharged by the print head driving circuit 14 in a mode as shown in FIG. 1 so that the stack of the piezoelectric elements 10 extends and contracts. The extension and the contraction of the stack of the piezoelectric elements 10 are transmitted through the parallel springs 50 to the lever 52, and then, the lever 52 multiplies the extension and the contraction of the stack of the piezoelectric elements 10. The lever 52 advances the printing wire 12 toward the sheet held on the platen and retracts the printing wire 12 through the wire 54.

Figure 8:
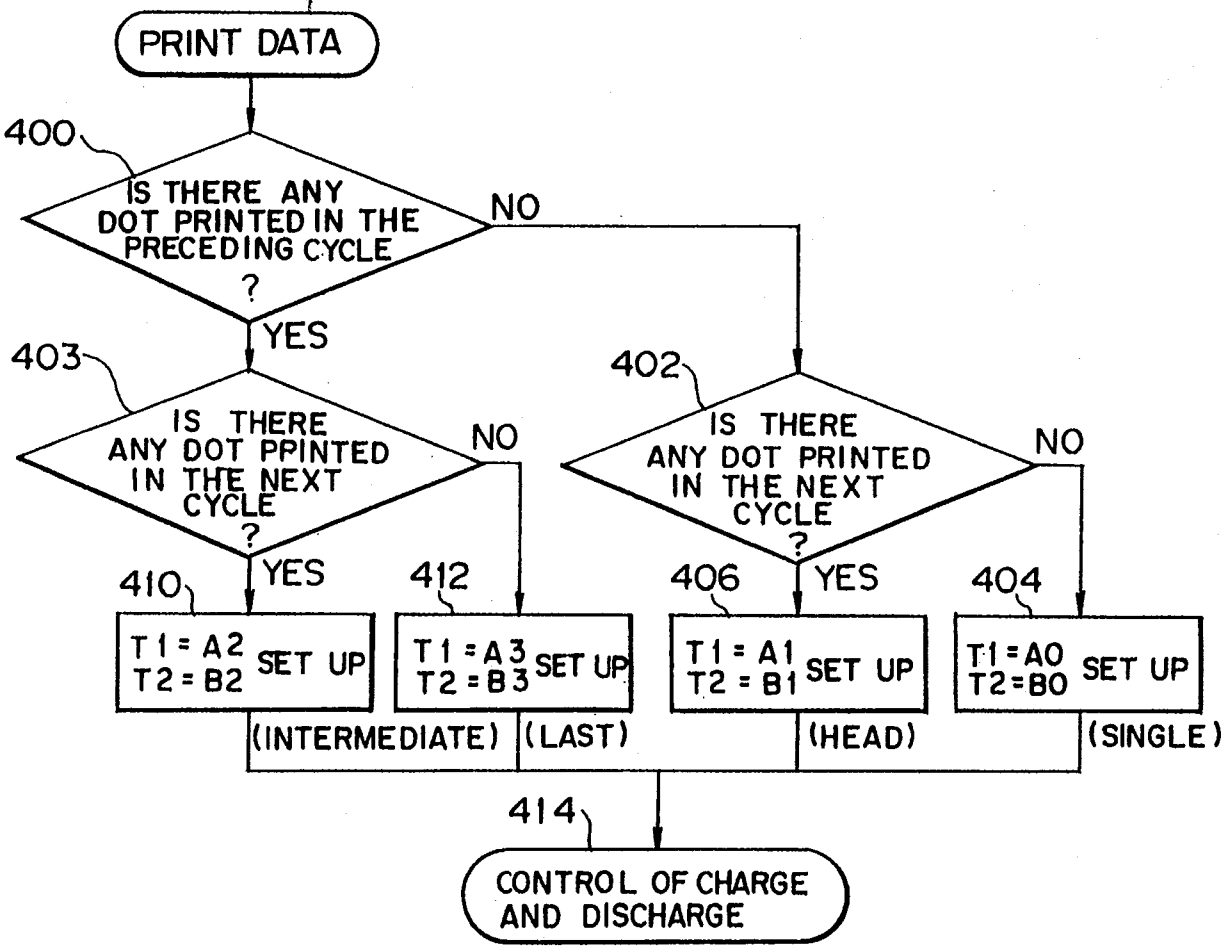
FIG. 8 is a flow chart of a program to be executed by the print head control device of FIG. 4.

The operation of the print head control device will be described hereinafter with reference to FIG. 8.

In step 400, a query is made to see if any dot has been printed in the preceding printing cycle. If the response in step S400 is negative, a query is made in step 402 to see if any dot is to be printed after a dot to be printed in the next printing cycle.

If no dot is to be printed in a printing cycle after the next, it is decided that a single dot is to be printed in the next printing cycle, the periods A0 and B0 are read from the ROM 46, and the charging period T1 and the discharge period T2 are set in step 404.

If no dot is printed in the preceding printing cycle and a dot is to be printed in a printing cycle after the next, it is decided that the head dot of a row of consecutive dots is to be printed, the periods A1 and B1 are read from the ROM 46 and the charging period T1 and the discharge period T2 are set in step 406.

If a dot is printed in the preceding printing cycle, a query is made in step 408 to see if any dot is to be printed in a printing cycle after the next. If a dot is printed in the preceding printing cycle and a dot is to be printed in a printing cycle after the next, it is decided that a dot among the intermediate dots of a row of consecutive dots is to be printed, the periods A2 and B2 are read from the ROM 46, and the charging period T1 and the discharge period T2 are set in step 410.

If a dot is printed in the preceding printing cycle and no dot is to be printed in a printing cycle after the next, it is decided that the last dot of a row of consecutive dots is to be printed in the next printing cycle, the periods A3 and B3 are read from the ROM 46, and the charging period T1 and the discharging period T2 are set in step 412.

In this embodiment, $A2 \leqq A1 \leqq A0$, $A2 \leqq A3$, and $B2 \leqq B1 < B0 \leqq B3$. The period A0 is sufficiently long to cancel the rebounding force of the printing wire 12, the period B0 is sufficient for the printing wire 12 to be fully retracted, the period A1 is determined so that the printing wire 12 is advanced by a sufficient driving force, the period B1 is determined so that the printing wire 12 is retracted by a reduced driving force, the periods A2 and B2 are determined so that the printing wire 12 is advanced by a reduced driving force and retraced by a reduced driving force, and the period A3 is longer than the period A2.

When print data representing a dot pattern shown in FIG. 9(A) is applied to the line buffer 42, the periods A0, A1, A2, A3, B0, B1, B2 and B3 are read from the ROM 46, the periods T1 and T2 are set accordingly in step 404,406,410 and 412, and the piezoelectric elements 10 are charged and discharged in a mode shown in FIG. 9(C).

In this embodiment, since the charging period T1 is set for an increased period sufficient for cancelling the rebounding force of the printing wire 12 when printing a single dot and when printing the last dot of a row of consecutive dots, the movement of the printing wire 12 toward the platen is suppressed as shown in FIG. 9(D) and, consequently, the printing of ghost dots as shown in FIG. 9(B) can be prevented to print dots with a high print quality.

As is apparent from the foregoing description, the present invention extends the charging period in which the piezoelectric elements are charged to advance the printing wire to cancel the rebounding force of the printing wire when printing a single dot and when printing the last dot of a row of consecutive dots, no ghost dot is formed after the single dot and after the last dot of a row of consecutive dots, so that characters and the like are printed at a high print quality.

Although the invention has been described in its preferred form with a certain degree of particularity, obviously many changes and variations are possible therein. It is therefore to be understood that the present invention may be practiced otherwise than as specifically described herein without departing from the scope and spirit thereof.

I claim:

1. A print head control device for a wire dot printer, comprising:

a print head driving circuit for charging and discharging piezoelectric elements to advance and retract a printing wire by the piezoelectric elements; and a print head control circuit for controlling the piezoelectric element charging and discharging operation of the print head driving circuit;

wherein said print head control circuit comprises:

a single dot detecting means for deciding from a print data if a single dot is to be printed in the next printing cycle;

a head dot detecting means for deciding if a head dot of a row of consecutive dots is to be printed in the next printing cycle;

a last dot detecting means for deciding if a last dot of a row of consecutive dots is to be printed in the next printing cycle;

an intermediate dot detecting means for deciding if a dot among intermediate dots of a row of consecutive dots is to be printed in the next printing cycle;

a first charging/discharging period setting means for setting a charging period A2 in which the printing wire is advanced by a reduced advancing force and a discharging period B2 in which the printing wire is retracted by a reduced retracting force, when the intermediate dot detecting means decides that the dot among the intermediate dots of the row of consecutive dots is to be printed in the next printing cycle;

a second charging/discharging period A3 setting means for setting a charging period longer than that for printing an intermediate dot and a discharging period B3 in which the printing wire is retracted by a sufficient retracting force, when the last dot detecting means decides that the last blot of the row of consecutive dots is to be printed in the next printing cycle; and a third charging/discharging period setting means for setting an increased charging period A0 long enough to cancel the rebounding force of the printing wire and a discharging period B0 in which the printing wire is retracted by a sufficient retracting force, when the single dot detecting means decides that the single dot is to be printed in the next printing cycle;

a fourth charging/discharging period setting means for setting a charging period A1 in which the printing wire is advanced by a sufficient driving force and a discharging period B1 in which the printing wire is retracted by a reduced retracting force, when the head dot detecting means decides that the head dot of the row of consecutive dots is to be printed in the next printing cycle;

control means for controlling charging/discharging operation for charging and discharging the piezoelectric elements according to the charging periods and the discharging periods set by the first charging/discharging period setting means, the second charging/discharging period setting means, the third charging/discharging period setting means and the fourth charging/discharging period setting means, such that $A2<A1<A0$; $A2<A3$ and $B2<B1<B0<B3$.

2. A print head control device for a wire dot printer, comprising:

a print head driving circuit for charging and discharging piezoelectric elements to advance and retract a printing wire by the piezoelectric elements; and a print head control circuit for controlling the piezoelectric element charging and discharging operation to the print head driving circuit;

wherein said print head control circuit comprises:

a line buffer for temporarily storing print data;

a dot pattern detecting unit for decoding the print data read from the line buffer to convert the print data into a corresponding dot pattern;

a printing wire selecting unit for selecting a printing wire among those of the print head according to the dot pattern given thereto from the dot pattern detecting unit, and giving a signal indicating the selected printing wire to the print head driving circuit;

a dot pattern analyzing unit for deciding from the dot pattern if a dot to be printed in the next printing cycle is a single dot, the head dot of a row of consecutive dots, a dot among the intermediate dots of a row of consecutive dots or the last dot of a row of consecutive dots; and a driving period setting unit for selectively reading driving periods corresponding to decisions made by dot pattern analyzing unit from a driving period storage unit and for controlling the print head driving circuit according to the driving periods read from the driving period storage unit, wherein said driving period storage unit comprises at least three non-zero charging periods, wherein none of said charging periods is equal to another charging period, and three non-zero discharge periods, wherein none of said discharge periods is equal to another discharge period.

3. A print head control device according to claim 2, wherein said driving period storage unit is a ROM storing charging periods and discharging periods suitable respectively for printing a single dot, the head dot of a row of consecutive dots, an intermediate dot of a row of consecutive dots and the last dot of a row of consecutive dots.

4. A print head control device for a wire dot printer, comprising:

a print head driving circuit for charging and discharging piezoelectric elements to advance and retract a printing wire by the piezoelectric elements; and a print head control circuit for controlling the piezoelectric element charging and discharging operation to the print head driving circuit;

wherein said print head control circuit comprises a next printing cycle dot detection device for determining from print data a dot type which is to be printed and communicating to a charging/discharging period setting device, wherein said charging/discharging period setting device sets a charging period and a discharging period as a function of the present state of the piezoelectric element and the type of dot which is to be printed, from at least three non-zero charge periods, wherein none of said charging periods is equal to another charging period, and at least three non-zero discharge periods, wherein none of said discharge periods is equal to another discharge period, so as to substantially prevent the occurrence of ghost dots.

5. A print-head control system for a wire-dot printer, said system comprising:

A print-head drive circuit to charge and discharge piezoelectric elements to advance and retract a printing wire by means of the piezoelectric elements, and A print-head control circuit to control the charge and discharge operation of the print-head drive circuit for the piezoelectric elements, the print-head control circuit comprising:

detection devices for determining whether a single dot, or a first dot of a series of consecutive dots, or a last dot of a series of consecutive dots shall be printed in a next print cycle;

charge/discharge period-setting devices to set a charging period A2 during which the printing wire shall be moved forward at reduced advancing force, and a discharge period B2 during which the printing wire is retracted at reduced retraction force when the detection devices decide that a dot from the intermediate dots of the series of consecutive dots shall be printed in the next printing cycle, to set a charging period A3 and a discharging period B3 during which the printing wire shall be retracted with adequate retraction force when the detection devices decide that the last dot of the series of consecutive dots shall be printed in the next printing cycle, to set a charging period A0 and a discharging period B0 during which the printing wire shall be retracted with adequate retraction force when the detection devices decide that the single dot shall be printed in the next printing cycle, and to set a charging period A1 during which the printing wire is advanced with adequate advancing force and a discharge period B1 during which the printing needle is retracted at reduced retraction force when the detection devices decide that the first dot of the series of consecutive dots shall be printed in the next printing cycle;

control devices to control the charging/discharging operation to charge and discharge the piezoelectric elements in relation to the periods of charging and discharging set by the charging-discharging devices wherein, the charge/discharge setting devices set an extended charging period A0 and an extended charging period A3 each long enough to eliminate the recoil force of the printing wire when the single dot, or the last dot of the series of consecutive dots shall be printed, and in that the charging and discharging periods obey the following relations, $A2<A1<A0$; $A2<A3$, and $B2<B1<B0<B3$.

6. A print head control system as claimed in claim 5, wherein the print-head control circuit comprises a line buffer to temporarily store printing data.

7. A print-head control system as claimed in claim 5, wherein the print-head control circuit comprises a dot-pattern decoding unit to decode printing data in order to convert the printing data into a corresponding dot pattern.

8. A print-head control system as claimed in claim 7, wherein the print-head control circuit is capable of reading the printing data from the line buffer.

9. A print-head control system as claimed in claim 7, wherein the print-head control circuit comprises a printing-wire selection unit to select a printing wire among printing wires of the print head according to the dot pattern transmitted to it from dot-pattern detection unit, said selection unit further transmitting a signal denoting the selected printing wire to the print-head drive circuit.

10. A print-head control system as claimed in claim 7, wherein the detection devices of the print-head control circuit comprise a dot-pattern analyzing unit which, on the basis of the dot pattern from the dot-pattern decoding unit decides whether the dot to be printed in the next printing cycle shall be the single dot, or the first dot of the series of consecutive dots, or the dot from among the intermediate dots of the series of consecutive dots, or the last dot of the series of consecutive dots.

11. A print-head control system as claimed in claim 10, wherein the charge/discharge setting devices of print-head control circuit comprise the following:

a drive-period control unit to store charging/discharging periods as drive-periods, and a drive-period setting unit to selectively read the charging/discharging periods as drive periods on the basis of a decision made by the dot-pattern analyzing unit for the purpose of controlling the print-head drive circuit according to the drive periods read from the drive-periods storage unit.

12. A print-head control system as claimed in claim 11, wherein the drive-periods storage unit comprises a ROM for storing the charging periods and the discharging periods.

13. A print-head control system as claimed in claim 5, wherein the print-head drive circuit charges and discharges the piezoelectric elements in such manner that they expand and contract and in that parallel springs transmit such expansions and contractions of said piezoelectric elements to a lever linked to the printing wire which thereby is advanced and retracted respectively.

14. A print-head control system as claimed in claim 5, wherein the charging periods A0 and A3 are extended in such manner that a maximum or saturation voltage is applied a given time to the piezoelectric elements.

* * * * *